US011458735B2

(12) United States Patent
Tanaka

(10) Patent No.: US 11,458,735 B2
(45) Date of Patent: Oct. 4, 2022

(54) LIQUID DISCHARGE APPARATUS

(71) Applicant: BROTHER KOGYO KABUSHIKI KAISHA, Nagoya (JP)

(72) Inventor: Mitsugi Tanaka, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 23 days.

(21) Appl. No.: 17/120,665

(22) Filed: Dec. 14, 2020

(65) Prior Publication Data

US 2021/0178770 A1 Jun. 17, 2021

(30) Foreign Application Priority Data

Dec. 16, 2019 (JP) ..... JP2019-226505

(51) Int. Cl.
*B41J 2/175* (2006.01)
*B41J 2/17* (2006.01)

(52) U.S. Cl.
CPC ..... *B41J 2/1752* (2013.01); *B41J 2/1721* (2013.01)

(58) Field of Classification Search
CPC ..... B41J 2/1752; B41J 2/1721
See application file for complete search history.

(56) References Cited

U.S. PATENT DOCUMENTS

2021/0283918 A1* 9/2021 Takabayashi ..... B41J 29/13
2021/0283931 A1* 9/2021 Ikagawa ..... B41J 2/16508

FOREIGN PATENT DOCUMENTS

JP 2013-220531 A 10/2013
JP 2015-120578 A 7/2015

* cited by examiner

*Primary Examiner* — Justin Seo
(74) *Attorney, Agent, or Firm* — Scully, Scott, Murphy & Presser, P.C.

(57) ABSTRACT

A liquid discharge apparatus includes: a casing having: a first surface and a second surface positioned apart in a first direction; a third surface and a fourth surface positioned apart in a second direction; and a fifth surface and a sixth surface positioned apart in a third direction; a head; a tank storing a liquid to be supplied to the head; and a sheet accommodating portion accommodating a sheet. The tank is positioned between the first surface and the sheet accommodating portion in the first direction. A range occupied by the tank at least partially overlaps with a range occupied by the sheet accommodating portion in the second direction. A range occupied by the tank at least partially overlaps with a range occupied by the sheet accommodating portion in the third direction.

20 Claims, 9 Drawing Sheets

LIQUID DISCHARGE APPARATUS

CROSS REFERENCE TO RELATED APPLICATION

The present application claims priority from Japanese Patent Application No. 2019-226505 filed on Dec. 16, 2019, the disclosure of which is incorporated herein by reference in its entirety.

BACKGROUND OF THE INVENTION

Field of the Invention

The present disclosure relates to a liquid discharge apparatus in which a sheet, a supporter (a support material), and a tank are arranged in an internal space of a casing.

Description of the Related Art

In a liquid discharge apparatus, a sheet onto which liquid droplets are discharged from a head, and a tank for supplying liquid to the head are arranged in an internal space of a casing (Japanese Patent Application Laid-open No. 2015-120578).

A sheet accommodating portion and the head or the like is disposed in the conveying region of the sheet in the internal space of the casing. On the other hand, it is necessary to arrange the tank so that it does not come into contact with the conveyed sheet. From the function of each such member, there is a constraint on the arrangement in the internal space of the casing of the device. Further, sheets and liquids stored in the tank are consumed in recording images. In order to save the user's labor, it is desirable to make the time required to replenish the sheet or the liquid as long as possible. For that purpose, it is inevitable to increase the volume of the sheet accommodating portion and the tank. Therefore, there is a problem that leads to an increase in the size of the apparatus.

The present disclosure has been made in view of the above circumstances, and an object of the present disclosure is to provide a mechanism capable of efficiently arranging a sheet accommodating portion and a tank in an internal space of a casing, and reducing dimensions of an apparatus in a front-rear direction and a left-right direction.

SUMMARY

According to an aspect of the present disclosure, there is provided a liquid discharge apparatus, including:

- a casing having: a first surface and a second surface positioned apart from each other in a first direction; a third surface and a fourth surface positioned apart from each other in a second direction perpendicular to the first direction; and a fifth surface and a sixth surface positioned apart from each other in a third direction perpendicular to the first direction and the second direction;
- a head positioned in an internal space of the casing and configured to discharge a liquid droplet;
- a tank positioned in the internal space of the casing and configured to store a liquid to be supplied to the head; and
- a sheet accommodating portion positioned in the internal space of the casing and configured to accommodate a sheet,

- wherein the tank is positioned between the first surface of the casing and the sheet accommodating portion in the first direction,
- a range in the second direction occupied by the tank at least partially overlaps with a range in the second direction occupied by the sheet accommodating portion, and
- a range in the third direction occupied by the tank at least partially overlaps with a range in the third direction occupied by the sheet accommodating portion.

DESCRIPTION OF THE EMBODIMENTS

An image recording apparatus 100 according to an embodiment of the present disclosure is explained below. Note that the embodiment explained below is merely an example of the present disclosure, and it goes without saying that the embodiment can be appropriately changed in a range that does not alter the gist or essential characteristics of the present disclosure. In the following, movement directed from a start point to an end point of an arrow is expressed as an orientation, and reciprocating movement on a line connecting the start point and the end point of the arrow is expressed as a direction. Further, an up-down direction (a third direction) 7 is defined with reference to a state (the state of FIG. 1) where the image recording apparatus 100 is usably disposed. A front-rear direction (a first direction) 8 is defined assuming a side provided with a discharge opening 33 to be a front side (a front surface). A left-right direction (a second direction) 9 is defined viewing the image recording apparatus 100 from the front side (front surface).

<Configuration of External Appearance of Image Recording Apparatus 100>

Figure 1:
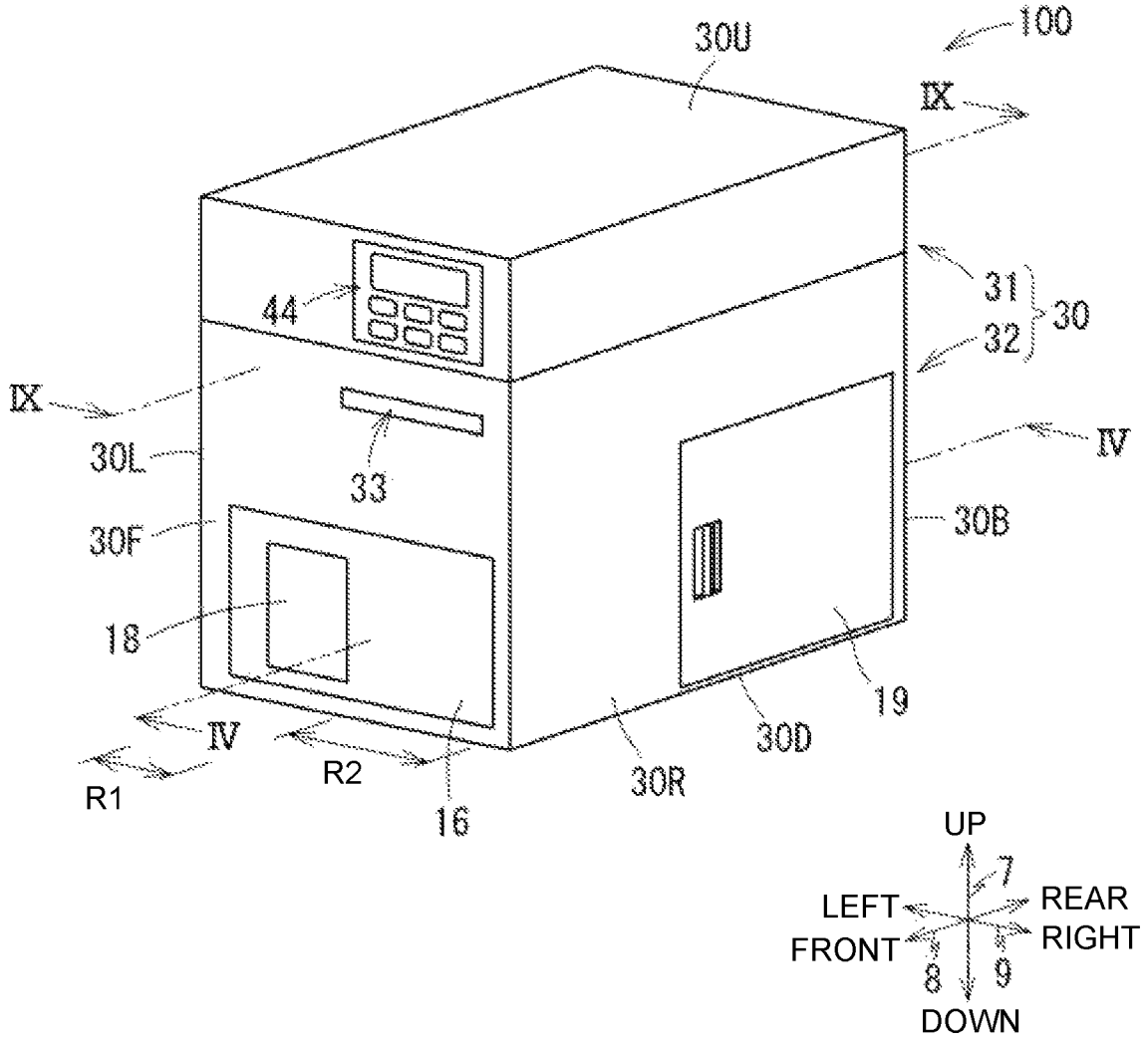
FIG. 1 is a perspective view of an external appearance of an image recording apparatus according to an embodiment of the present disclosure.

The image recording apparatus 100 (an example of a liquid discharge apparatus) depicted in FIG. 1 records an image on a sheet S formed in a roll body (sheet roll) 37 (see FIG. 4) in accordance with an ink-jet recording system.

As depicted in FIG. 1, the image recording apparatus 100 includes a casing 30. The casing 30 includes an upper casing 31 and a lower casing 32. The upper casing 31 and the lower casing 32 have a substantially rectangular parallelepiped shape as a whole, and have a size that can be placed on a table. The following explanation of the casing 30 is made in a state where the upper casing 31 and the lower casing 32 have the rectangular parallelepiped shape as a whole.

The casing 30 has a right surface 30R, a left surface 30L, an upper surface 30U, a lower surface 30D, a front surface 30F, and a rear surface 30B. The right surface 30R and the left surface 30L are positioned apart in the left-right direction 9. The upper surface 30U and the lower surface 30D are positioned apart in the up-down direction 7. The front surface 30F and the rear surface 30B are positioned apart in the front-rear direction 8. That is, the casing 30 has the front surface 30F and the rear surface 30B (an example of a first surface and an example of a second surface) positioned apart in the front-rear direction (the first direction) 8, the left surface 30L and the right surface 30R (an example of a third surface and an example of a fourth surface) positioned apart in the left-right direction (the second direction) 9 perpendicular to the front-rear direction (the first direction) 8, and the upper surface 30U and the lower surface 30D (an example of a fifth surface and an example of a sixth surface) positioned apart in the up-down direction (the third direction) 7 perpendicular to the front-rear direction (the first direction) 8 and the left-right direction (the second direction) 9.

Figure 2:
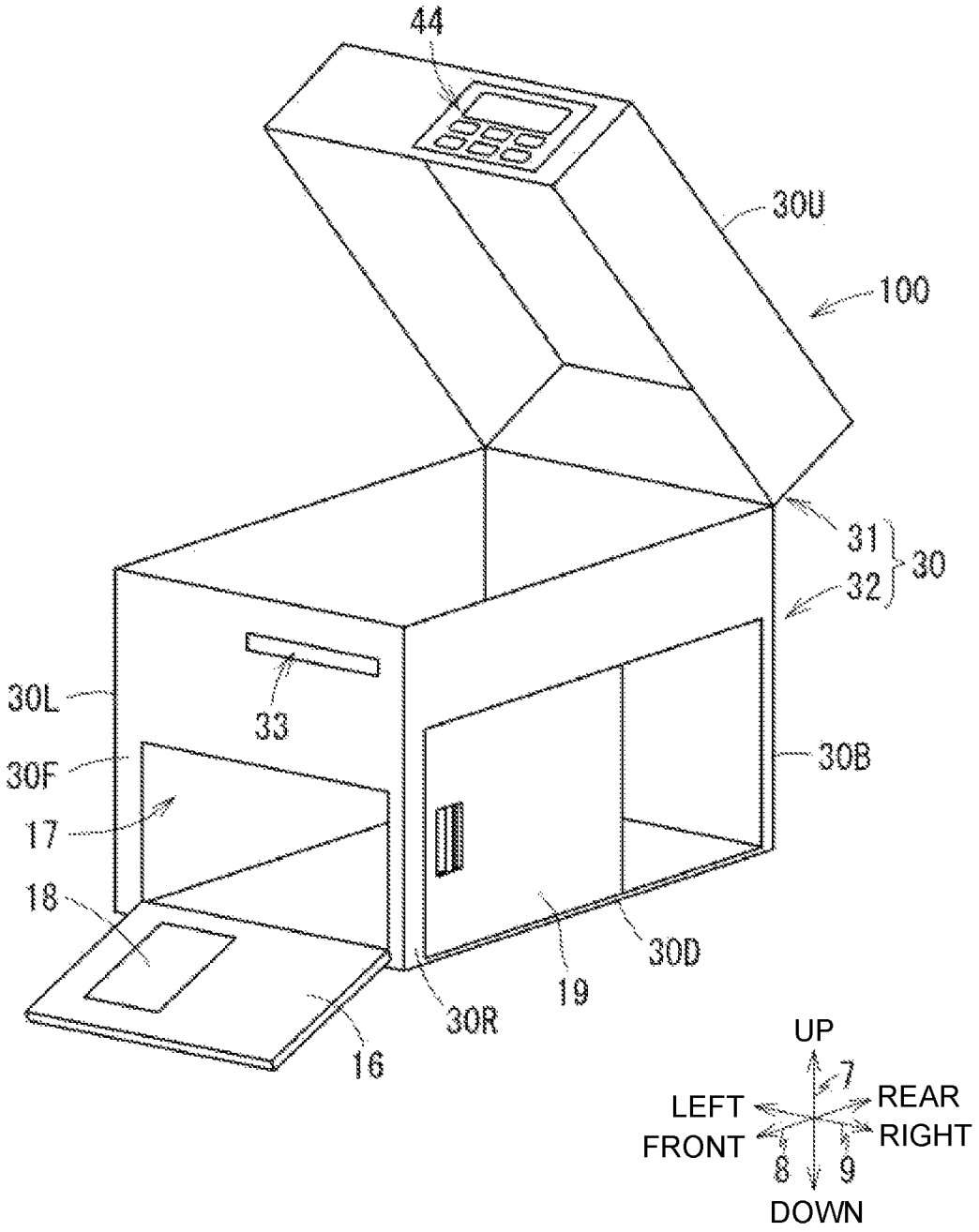
FIG. 2 is a perspective view of an external appearance of the image recording apparatus with a front cover and a right cover opened.

The rear surface 30B of the upper casing 31 is connected to the lower casing 32 so that the upper casing 31 is pivotable around a pivot axis extending in the left-right direction 9. The upper casing 31 pivotally moves from a closed position depicted in FIG. 1 so that the front surface 30F is lifted upward to an opened position depicted in FIG. 2. When the upper casing 31 is in the opened position, an internal space 30A of the casing 30 (see FIG. 4) is exposed to the outside. In FIG. 2, an internal structure of the casing 30 is omitted.

As depicted in FIG. 1, the front surface 30F of the casing 30 is formed having the discharge opening 33 that is long in the left-right direction 9. A center portion in the left-right direction 9 of the discharge opening 33 is positioned at the right of a center portion in the left-right direction 9 of the front surface 30F. The discharge opening 33 causes the internal space 30A of the casing 30 to communicate with the outside. The sheet S for which image recording has been performed in the internal space 30A of the casing 30 is discharged to the outside of the casing 30 through the discharge opening 33.

An operation panel 44 is provided on the front surface 30F of the casing 30. The operator panel 44 is positioned above the discharge opening 33. A user inputs, to the operation panel 44, instructions for operating the image recording apparatus 100 and confirming a variety of kinds of settings.

The front surface 30F of the casing 30 (a front wall including the front surface 30F) is provided with a front cover 16. The front cover 16 is positioned below the discharge opening 33. The front cover 16 is pivotable around a pivot axis extending on the front surface 30F in the left-right direction 9 with an upper end of the front cover 16 in the closed position depicted in FIG. 1 as a pivot end. When the upper end of the front cover 16 in the closed position pivots to be pulled forward, the front cover 16 has the opened position depicted in FIG. 2.

As depicted in FIG. 2, when the front cover 16 is in the opened position, an opening 17 formed in the front surface 30F is opened. The opening 17 allows the internal space 30A of the casing 30 to communicate with the outside. A user is accessible to a tank 34 (see FIG. 5) and a waste liquid tank 47 (see FIG. 5) arranged in the internal space 30A of the casing 30 through the opening 17 opened. The opening 17 is opened and closed by the front cover 16 as described above.

The front cover 16 is provided with a window 18. The window 18 may be a through hole formed in the front cover 16. The through hole as the window 18 may be sealed with a translucent member. A user can visually recognize the internal space 30A from the outside of the casing 30 through the window 18 of the front cover 16 in the closed position. The window 18 of the front cover 16 in the closed position faces the tank 34. The user can thus visually recognize the tank 34 from the outside of the casing 30 through the window 18, even when the front cover 16 is in the closed position. The user can visually recognize a liquid level of ink stored in the tank 34 by forming at least part of the tank 34 by a translucent member.

As depicted in FIG. 1, when the front cover 16 is in the closed position, a range R1 occupied by the window 18 does not completely overlap with a range R2 occupied by the discharge opening 33 in the left-right direction 9. At least part of the range R1 occupied by the window 18 does not overlap with the range R2 occupied by the discharge opening 33 in the left-right direction 9. Only at least part of the range R1 may overlap with the range R2, or the range R1 may not overlap with the range 2 completely. Part of the range R1 is positioned at the left of a left end of the range R2. That is, a right portion of the window 18 is directly below the discharge opening 33, while a left portion of the window 18 is not directly below the discharge opening 33.

Figure 3:
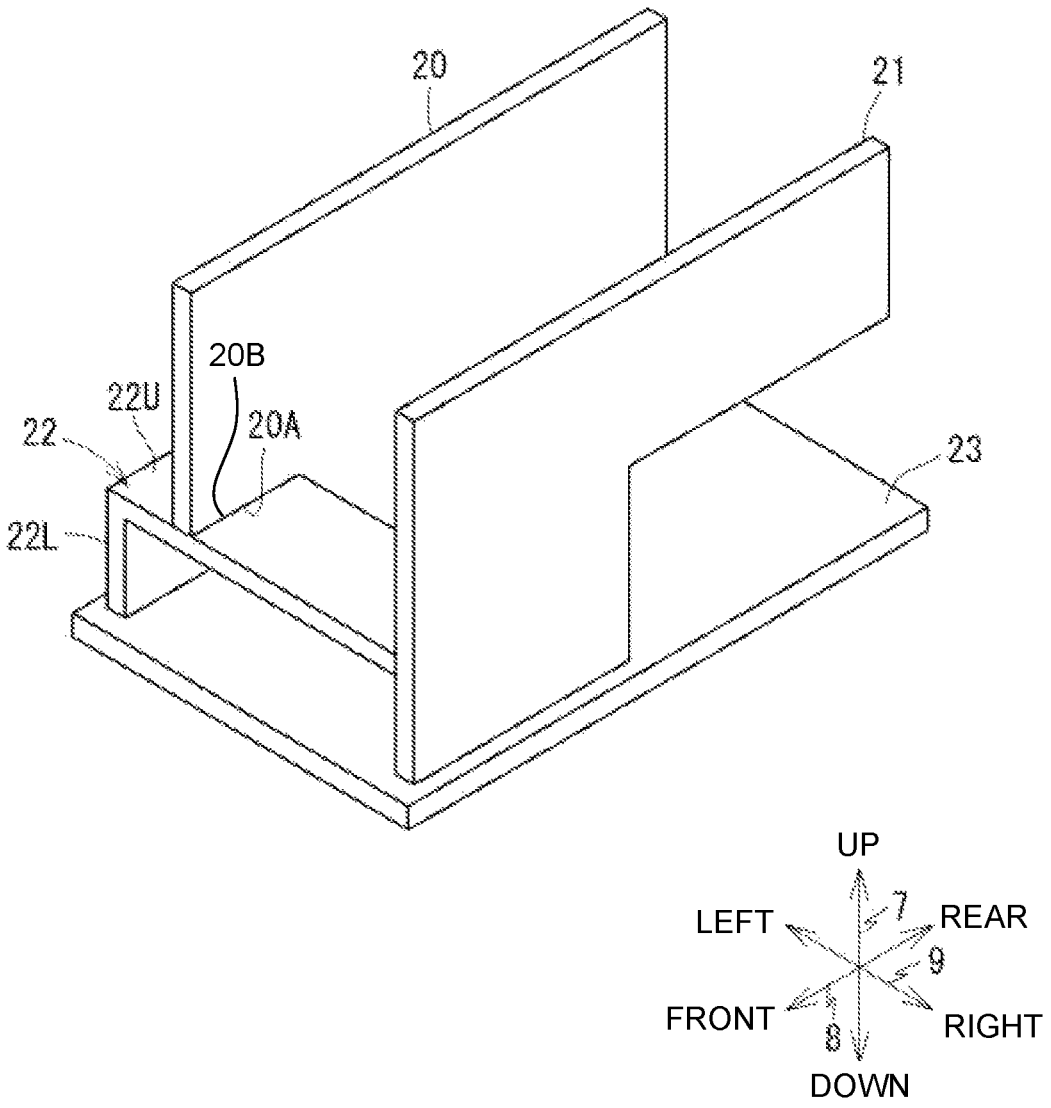
FIG. 3 is a perspective view depicting side frames and a subframe attached to a base.
Figure 5:
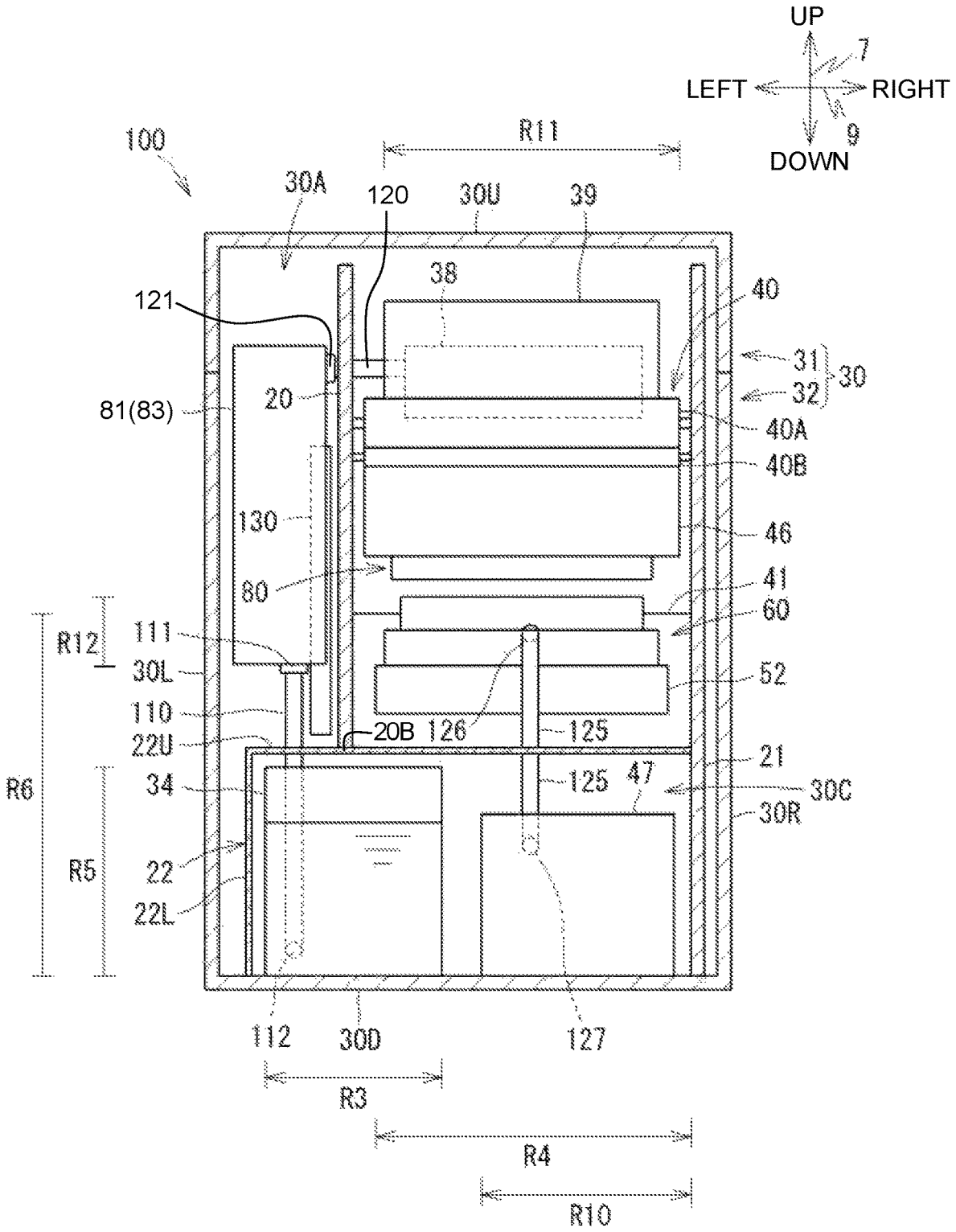
FIG. 5 is a cross-sectional view taken along a line V-V of FIG. 4.

As depicted in FIG. 3, the internal space 30A of the casing 30 is provided with two side frames 20 and 21 (an example of a first side frame and an example of a second side frame) and a subframe 22. Each of the side frames 20 and 21 has a flat plate shape made from a steel plate. A cutout (notch) and/or a through hole is/are appropriately formed in each of the side frames 20 and 21. The cutout and/or the through hole have a shape(s) depending on a member supported by each of the side frames 20 and 21. Each of the side frames 20 and 21 may be bent to increase strength. The two side frames 20 and 21 are positioned apart in the left-right direction 9. Although not depicted in FIG. 3, the side frames 20 and 21 form an integral frame structure by using any other frame coupling the side frames 20 and 21. The side frames 20 and 21 are coupled to a base 23 that forms the lower surface 30D of the casing 30. The frames, including the side frames 20 and 21, are coupled with each other by screws, welding, or the like. As depicted in FIG. 5, in the left-right direction 9, the left surface (the third surface) 30L of the casing 30, the left side frame (the first side frame) 20, the right side frame (the second side frame) 21, and the right surface (the fourth surface) 30R of the casing 30 are arranged in this order.

Of the two side frames 20 and 21, a front lower corner of the side frame 20 positioned at the left in the left-right direction 9 is formed having a cutout (notch) 20A. A front end of the side frame 20 is thus not coupled to the base 23, and the front end of the side frame 20 has a space corresponding to the cutout 20A. The space corresponding to the cutout 20A is provided with the subframe 22.

The subframe 22 has a frame shape having an upper wall (a second wall) 22U and a left wall (a first wall) 22L. The left wall 22L and the side frame 21 are positioned apart in the left-right direction 9. The upper wall 22U couples an upper end of the left wall 22L to the side frame 21. A lower end of the left wall 22L is coupled to the base 23. The upper wall 22U is coupled to the cutout 20A of the side frame 20. The subframe 22 is thus positioned below the front portion of the side frame 20 so that the subframe 22 and the two side frames 20, 21 form the integral frame. The tank 34 is positioned in a space surrounded by the side frame 21 and the subframe 22 (see FIG. 5).

The left wall (the first wall) 22L of the subframe 22 faces the tank 34 in the left-right direction 9. The upper wall (the second wall) 22U faces the tank 34 in the up-down direction 7. Part of the left side frame (the first side frame) 20 at a side of the front surface (the first surface) 30F in the front-rear direction 8 forms a coupling portion 20B by being coupled to the subframe 22. The tank 34 is positioned between the coupling portion 20B and the lower surface (the sixth surface) 30D of the casing 30 in the up-down direction 7.

The cutout 20A of the left side frame (the first side frame) 20 is formed at a corner positioned at the side of the front surface (the first surface) 30F in the front-rear direction 8 and positioned at a side of the lower surface (the sixth surface) 30D in the up-down direction 7. The upper wall (the second wall) 22U of the subframe 22 extends in the left-right direction 9 and is coupled to the part of the left side frame (the first side frame) 20 formed having the cutout 20A, thus forming the coupling portion 20B. Further, the upper wall (the second wall) 22U is coupled to the right side frame (the second side frame) 21. The left wall (the first wall) 22L of the subframe 22 is positioned between the left side frame (the first side frame) 20 and the left surface (the third surface) 30L of the casing 30 in the left-right direction 9. The left wall (the first wall) 22L extends in the up-down direction 7 to couple the upper wall (the second wall) 22U of the subframe 22 to a wall including the lower surface (the sixth surface) 30D of the casing 30 (i.e., the base 23). The tank 34 is positioned between the left wall (the first wall) 22L of the subframe 22 and the right side frame (the second side frame) 21 in the left-right direction 9 and positioned between the upper wall (the second wall) 22U of the subframe 22 and the lower surface (the sixth surface) 30D of the casing 30 in the up-down direction 7.

<Internal Configuration of Image Recording Apparatus 100>

Figure 4:
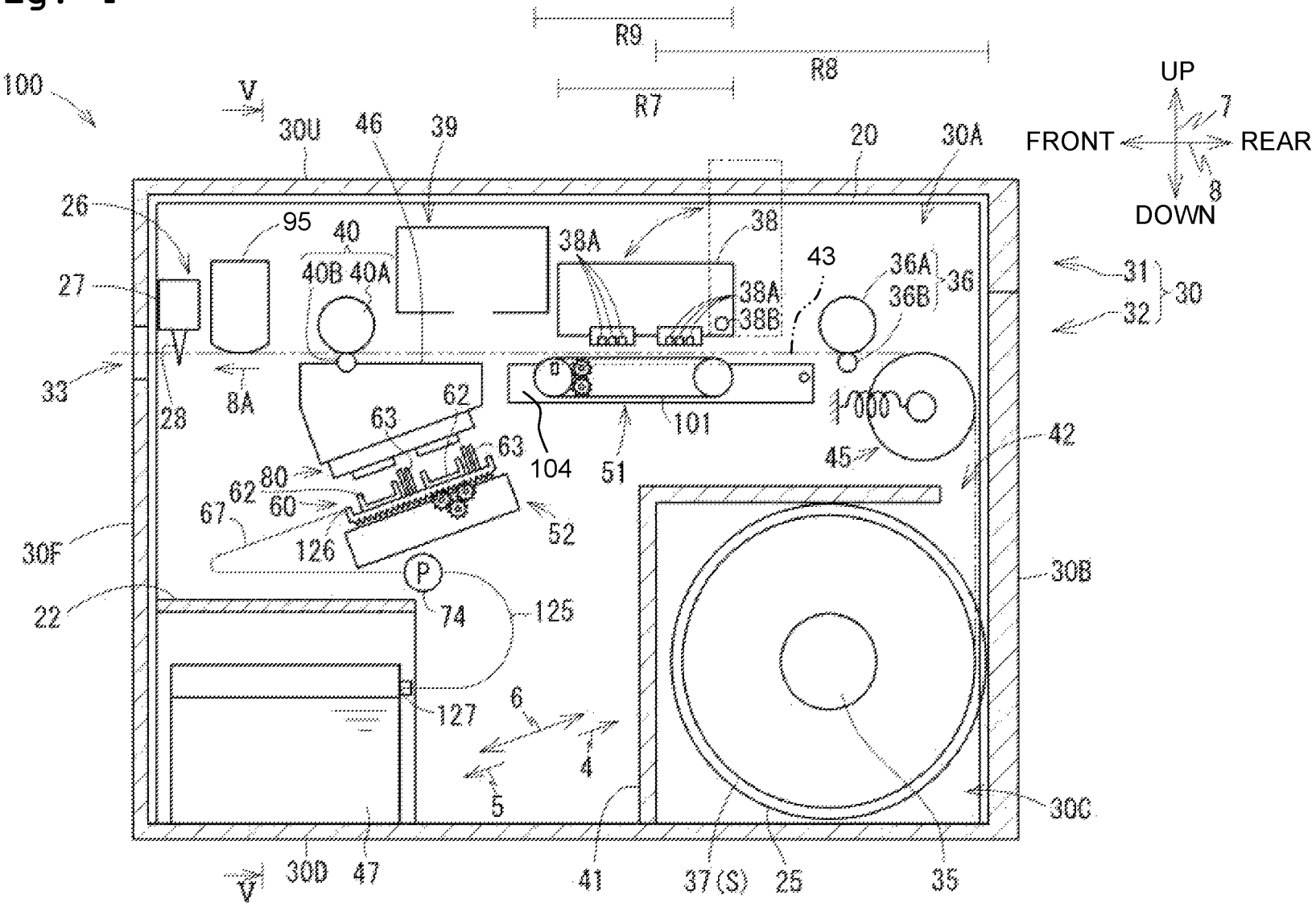
FIG. 4 is a cross-sectional view taken along a line IV-IV of FIG. 1, wherein a maintenance unit is in a standby position.

As depicted in FIG. 4 and FIG. 5, a holder 35, a tensioner 45, a conveyance roller pair 36, a discharge roller pair 40, a head 38, the first support mechanism 51 (an example of a support mechanism), a fixing unit 39, a support member 46, the second support mechanism 52, a contact image sensor (CIS) 95, a cutter unit 26, the tank 34, a maintenance unit 60, a wiper cleaning unit 80, and a substrate 130 on which electronic elements serving as a controller (a main controller) are mounted are arranged in the internal space 30A.

In the internal space 30A, a partition wall 41 is provided between the side frames 20 and 21 in the left-right direction 9. The partition wall 41 partitions a rear lower portion of the internal space 30A to define a sheet accommodating space 30C (an example of a sheet accommodating portion). The sheet accommodating space 30C is a space surrounded by the partition wall 41 and the lower casing 32 and separated or isolated from the head 38 and the like.

The roll body 37 is accommodated in the sheet accommodating space 30C. The roll body 37 has a core tube and the long sheet S. The sheet S is wound around the core tube in a roll shape in a circumferential direction of an axial core of the core tube. The sheet S may have a width ranging from a minimum width to a maximum width in which the image recording apparatus 100 is capable of recording an image. That is, a plurality of types of the roll body 37 having different widths are accommodatable in the sheet accommodating space 30C. The roll body 37 may not have the core tube, and the sheet S may be formed in a roll shape so that the sheet S is installable in the holder 35. The sheet accommodating space 30C may accommodate a fan-folded paper.

The holder 35 extending in the left-right direction 9 is positioned in the sheet accommodating space 30C. The roll body 37 can be installed in the holder 35. When the roll body 37 is installed in the holder 35, the holder 35 supports the roll body 37 so that the axial core of the core tube of the roll body 37 is along the left-right direction 9 and the roll body 37 is rotatable in the circumferential direction of the axial core.

As depicted in FIG. 4, the holder 35 is provided with a pair of side guides 25 separated from each other in the left-right direction 9. A distance between the side guides 25 in the left-right direction 9 is changeable. A user moves the pair of side guides 25 so that the side guides 25 come into contact with or abut against left and right ends of the roll body 37 according to the width of the roll body 37 to be installed to the holder 35 (the size along the left-right direction 9). The roll body 37, of which left and right ends are brought into contact with the side guides 25, is positioned so that a center portion in the width direction of the sheet S is coincident with a center portion in the left-right direction 9 of a conveyance route 43 through which the sheet S is conveyed.

The holder 35 rotates when receiving driving force from a motor (not depicted). Along with the rotation of the holder 35, the roll body 37 supported by the holder 35 also rotates. As depicted in FIG. 1 and FIG. 2, the right cover 19 is positioned in the right surface 30R of the lower casing 32. Opening and closing the right cover 19 opens/closes the sheet accommodating space 30C (see FIG. 4) with respect to the outside. Opening the right cover 19 exposes the holder 35 to the outside, which allows a user to install the roll body 37 to the holder 35.

A rear portion of the sheet accommodating space 30C is opened upward. Specifically, a gap 42 is formed between the partition wall 41 and the rear surface 30B, that is, formed above a rear end of the roll body 37. Rotating the conveyance roller pair 36 and the discharge roller pair 40 pulls out the sheet S upward from the rear end of the roll body 37, and the sheet S pulled out is guided to the tensioner 45 via the gap 42.

In the internal space 30A, the tensioner 45 is positioned between the side frames 20 and 21 in the left-right direction 9. At a rear portion of the internal space 30A, the tensioner 45 is positioned above the partition wall 41. The tensioner 45 is a roller that is supported by the side frames 20 and 21 so that the tensioner 45 is rotatable and movable in the front-rear direction 8. Rearward urging force is applied to the tensioner 45 by an urging member such as a spring.

In the internal space 30A, the conveyance roller pair 36 is positioned between the side frames 20 and 21 in the left-right direction 9. The conveyance roller pair 36 is positioned at the front side of the tensioner 45. The conveyance roller pair 36 has a conveyance roller 36A and a pinch roller 36B. The conveyance roller 36A is rotatably supported by the side frames 20 and 21. The conveyance roller 36A rotates upon receiving driving force from a motor (not depicted), thus conveying the sheet S frontward (conveyance orientation 8A) while nipping the sheet S between the conveyance roller 36A and the pinch roller 36B.

In the internal space 30A, the discharge roller pair 40 (an example of a conveyance unit) is positioned between the side frames 20 and 21 in the left-right direction 9. The discharge roller pair 40 is positioned at the front side of the conveyance roller pair 36. The discharge roller pair 40 has a discharge roller 40A and a pinch roller 40B. The discharge roller 40A is rotatably supported by the side frames 20 and 21. The discharge roller 40A rotates upon receiving driving force from a motor (not depicted), thus conveying the sheet S frontward (conveyance direction 8A) while nipping the sheet S between the discharge roller 40A and the pinch roller 40B.

In the internal space 30A, the head 38 is positioned between the side frames 20 and 21 in the left-right direction 9. The head 38 is positioned downstream of the conveyance roller pair 36 in the conveyance orientation 8A. The head 38 has nozzles 38A. Ink is discharged downward, as liquid droplets, from the nozzles 38A toward the sheet S supported by a conveyance belt 101. Accordingly, an image is recorded on the sheet S. In this embodiment, ink contains a resin that is cured by ultraviolet light.

As depicted in FIG. 4, the head 38 is pivotable about a pivot axis 38B positioned at a rear end of the head 38 and extending in the left-right direction 9. The head 38 indicated by a solid line in FIG. 4 is in the first position where liquid droplets are discharged toward the first support mechanism 51. The head 38 indicated by a broken line in FIG. 4 is in the second position where an upper portion of the first support mechanism 51 is opened. That is, the head 38 in the second position opens part of the conveyance route 43.

In the internal space 30A, the first support mechanism 51 is positioned between the side frames 20 and 21 in the left-right direction 9. The first support mechanism 51 is positioned downstream of the conveyance roller pair 36 in the conveying orientation 8A. The first support mechanism 51, which is positioned below the head 38, faces the head 38. The first support mechanism 51 has the conveyance belt 101 (an example of a support material or a supporter) and a support portion 104. When the conveyance belt 101 receives driving force from a motor (not depicted), rotary motion of the conveyance belt 101 is caused to convey the sheet S in the conveyance orientation 8A in a state where the sheet S is supported by the conveyance belt 101. The support portion 104 is capable of supporting the maintenance unit 60 in a maintenance position (see FIG. 7).

In the internal space 30A, the fixing unit 39 is positioned between the side frames 20 and 21 in the left-right direction 9. The fixing unit 39 is positioned downstream of the head 38 in the conveyance orientation 8A and upstream of the discharge roller pair 40 in the conveying orientation 8A. That is, the fixing unit 39 is positioned between the front surface (the first surface) 30F of the casing 30 and the head 38 in the front-rear direction 8. The fixing unit 39 is an ultraviolet irradiator having a substantially rectangular parallelepiped shape that is long in the left-right direction 9. The fixing unit 39 irradiates the sheet S passing directly below the fixing unit 39 and ink on the sheet S with ultraviolet light. The resin in the ink irradiated with ultraviolet light is cured, and a pigment in the ink is fixed to the sheet S. That is, the fixing unit 39 fixes the ink (liquid) adhering to the sheet S to the sheet S.

The fixing unit 39 is not limited to the ultraviolet irradiator. For example, when ink contains thermoplastic resin fine particles, the fixing unit 39 may be a heater. In this case, the thermoplastic resin fine particles are melted by heating the sheet S and ink on the sheet S with the fixing unit 39, and the melted resin is cured by cooling performed thereafter. Accordingly, the pigment in ink is fixed to the sheet S.

In the internal space 30A, the support member 46 is positioned between the side frames 20 and 21 in the left-right direction 9. The support member 46 is positioned downstream of the head 38 and the first support mechanism 51 in the conveyance orientation 8A. A rear portion of the support member 46 faces the fixing unit 39. A front portion of the support member 46 faces the discharge roller 40A. The support member 46 supports the sheet S conveyed in the conveying orientation 8A by the conveying belt 101 of the first support mechanism 51.

The second support mechanism 52 is positioned below the support member 46. The second support mechanism 52 can support the maintenance unit 60 in a standby position.

The CIS 95 is positioned downstream of the discharge roller pair 40 in the conveyance orientation 8A. In the CIS 95, light that is emitted from a light source such as an LED is reflected by a sheet. The reflection light is collected to a line sensor by a refractive index distribution type lens. The line sensor outputs an electric signal depending on intense of the reflection light received. The CIS 95 can read an image on a printing surface (upper surface) of the sheet S. The CIS 95 is disposed so that a reading line extends in the left-right direction 9.

The cutter unit 26 is positioned downstream of the CIS 95 in the conveyance orientation 8A. In the cutter unit 26, a cutter 28 is carried on a cutter carriage 27. The cutter carriage 27 moves in the left-right direction 9 by a belt driving mechanism (not depicted). The cutter 28 moves in the left-right direction 9 along with movement of the cutter carriage 27. The sheet S positioned between the discharge roller pair 40 and the discharge opening 33 is cut along the left-right direction 9 through movement of the cutter 28.

As depicted in FIG. 5, the tank 34 is a container having a rectangular parallelepiped shape. The tank 34 stores ink in its internal space. The tank 34 is positioned in a space surrounded by the subframe 22 at a front lower side of the internal space 30A. The tank 34 is surrounded by the subframe 22, the side frame 21, and the base 23. The internal space of the tank 34 is connected to the head 38 via a tube (not depicted) so that ink is supplied to the head 38. In this embodiment, the tank 34 is a cartridge-type that is removable with respect to the casing 30.

As depicted in FIG. 4 and FIG. 5, the waste liquid tank 47 is a container having a rectangular parallelepiped shape. The waste liquid tank 47 holds ink in its internal space. The waste liquid tank 47 is positioned between the subframe 22 and the side frame 21 at the lower front side of the internal space 30A. The waste liquid tank 47 is surrounded by the subframe 22, the side frame 21, and the base 23. The interior space of the waste liquid tank 47 is connected to the maintenance unit 60 via a tube (not depicted) so that ink discharged from the maintenance unit 60 flows therethrough. In this embodiment, the waste liquid tank 47 is a cartridge-type that is removable with respect to the casing 30.

As depicted in FIG. 5, the substrate 130 is positioned above the tank 34 at the outside of (at the left of) the side frame 20 supported by the subframe 22. The substrate 130 is fixed to the side frame 20. An arithmetic element serving as the controller, a chip for a communication interface, various connectors, and the like are mounted on the substrate 130. The substrate 130 is connected to the head 38, the motor(s), the operation panel 44, and the like via a flat cable(s) (not depicted) so that it is possible to send and receive an electrical signal. Electric power is supplied from a power supply unit (not depicted) to the substrate 130.

Figure 8:
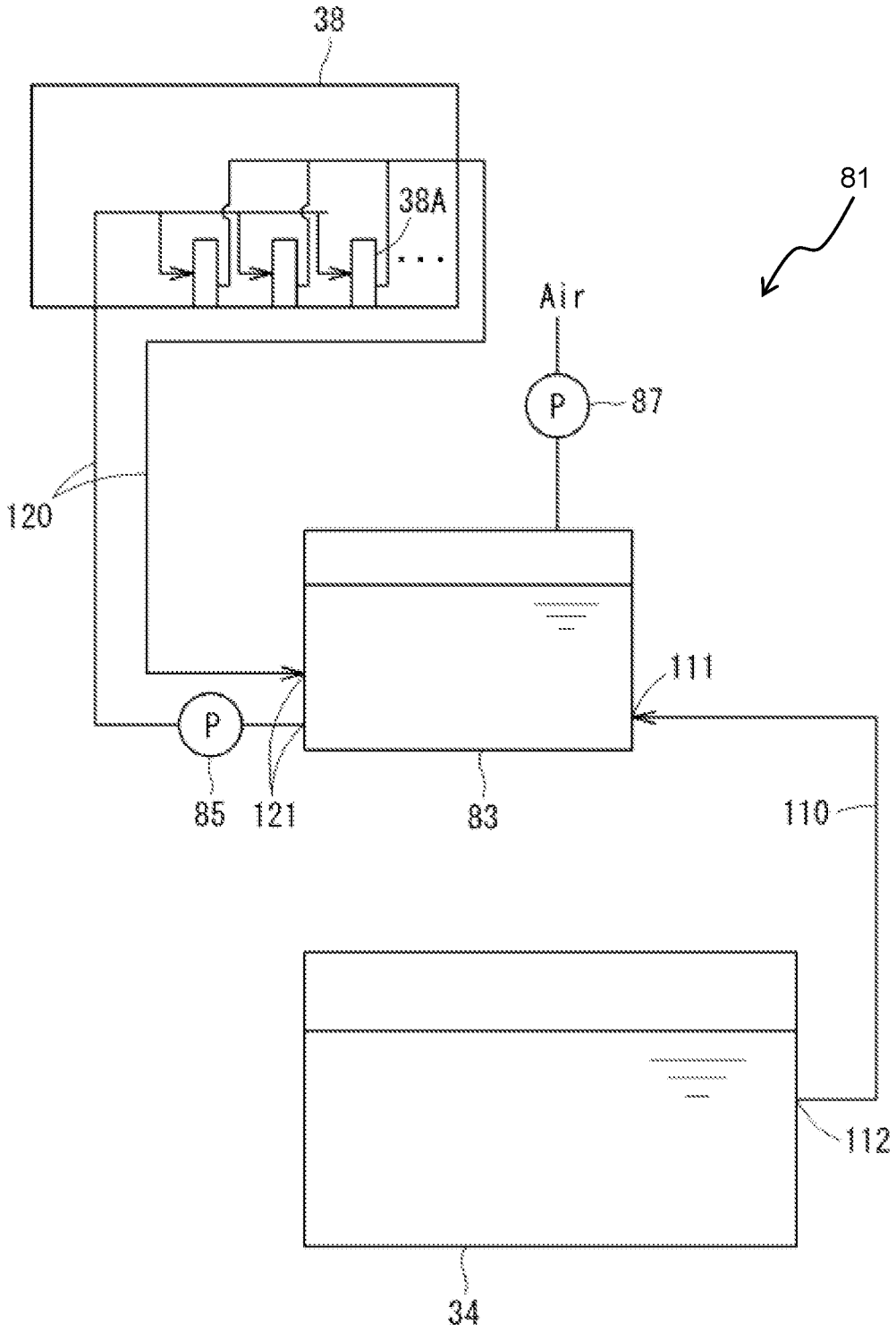
FIG. 8 depicts a schematic configuration of a circulation mechanism.
Figure 9:
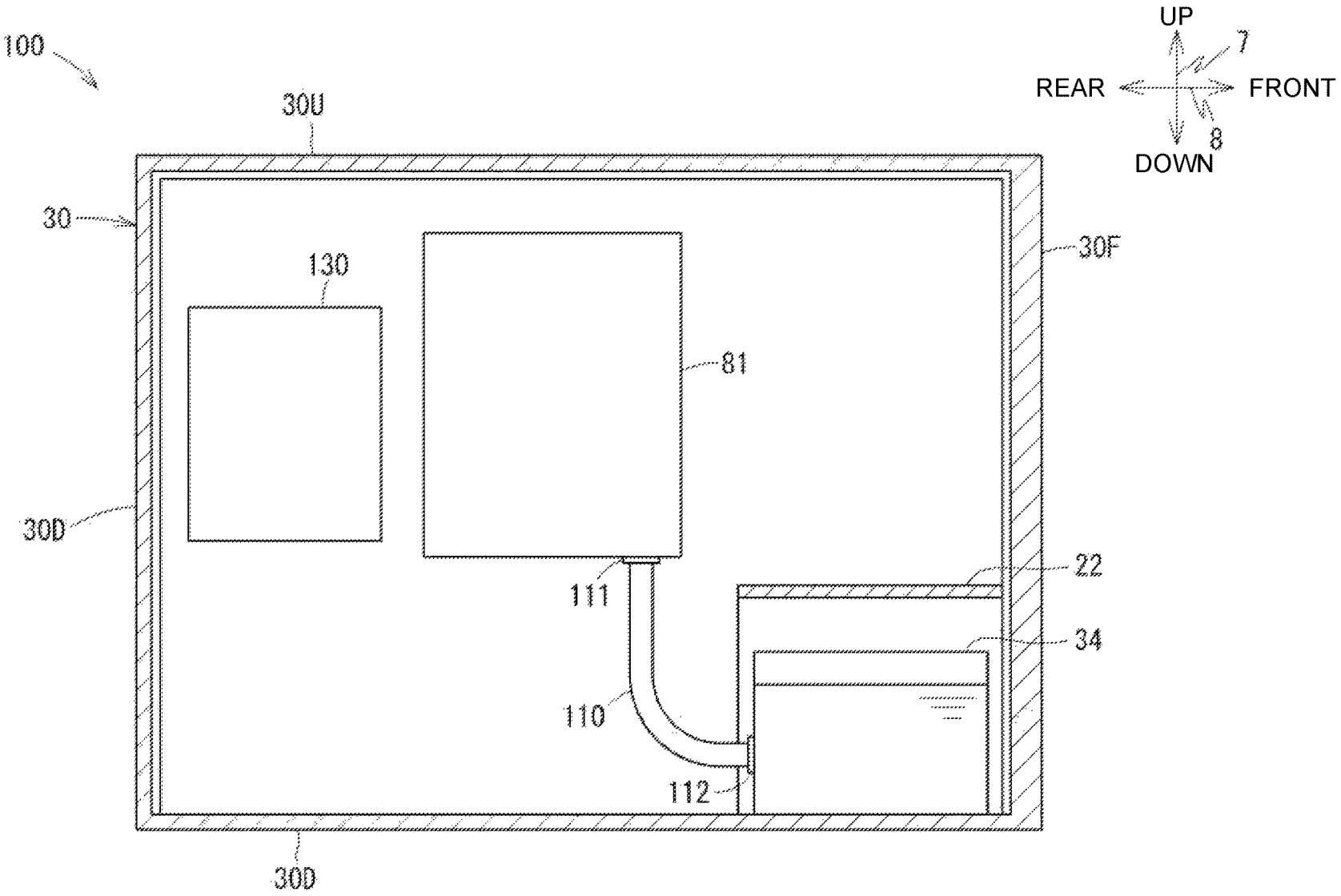
FIG. 9 is a cross-sectional view taken along a line IX-IX of FIG. 1.

As depicted in FIG. 5, a circulation mechanism 81 (an example of a supply unit) is positioned in the internal space 30A at the left of the side frame 20 in the left-right direction 9 (i.e., between the side frame 20 and the left surface (the third surface) 30L of the casing 30 in the left-right direction 9). The circulation mechanism 81 is positioned at the front side of the substrate 130 in the front-rear direction 8. The circulation mechanism 81 is supported by the side frame 20. As depicted in FIG. 8, the circulation mechanism 81 includes a subtank 83, the first pump 85 (an example of a pump), and the second pump 87. The subtank 83 and pumps 85 and 87 are connected to the tank 34 and the nozzles 38A of the head 38 via channels 110 and 120. Each of the channels 110 and 120 is provided with a valve as appropriate. In this embodiment, the valve is omitted. Each channel may be configured by a tube or the like.

Specifically, the tank 34 is connected to the subtank 83 by the channel 110, and ink can be supplied from the tank 34 to the subtank 83. The subtank 83 is in atmospheric communication with the outside via the second pump 87. When the second pump 87 is driven, pressure inside the subtank 83 becomes negative, and ink is supplied from the tank 34 to the subtank 83. When ink is supplied from the tank 34 to the subtank 83, the channel(s) 120 between the subtank 83 and the head 38 is/are closed. When the first pump 85 is driven, ink circulates through the channel(s) 120 between the subtank 83 and the nozzles 38A of the head 38.

The maintenance unit 60 performs maintenance of the head 38. The maintenance unit 60 is movable between the side frames 20 and 21 in the up-down direction 7 and the front-rear direction 8. The maintenance unit 60 is positioned directly below the head 38 when maintenance of the head 38 is performed (see FIG. 7, the maintenance position).

The maintenance of the head 38 includes a flushing process, a purge process, a wiping process, and the like. In the flushing process, ink is discharged toward the maintenance unit 60. In the purge process, ink is sucked from the nozzles 38A by a suction pump 74 in a state where the nozzles 38A are covered with a cap 62 of the maintenance unit 60. In the wiping process, a nozzle surface of the head 38 is wiped with a wiper 63 of the maintenance unit 60. Ink discharged to the cap 62 through the flushing process and the purge process is discharged to the waste liquid tank 47 through a channel 125.

The wiper cleaning unit 80 cleans the wiper 63 of the maintenance unit 60. The wiper cleaning unit 80 faces downward by being supported by the support member 46. The maintenance unit 60 moves directly below the wiper cleaning unit 80 when cleaning of the wiper 63 is performed.

The maintenance unit 60 is movable in an inclination direction 6 by sliding with respect to the second support mechanism 52 in a state of being supported by the second support mechanism 52. The maintenance unit 60 supported by the second support mechanism 52 moves along the inclination direction 6, which allows the wiper 63 to move while being brought into contact with the wiper cleaning unit 80. This wipes ink adhering to the wiper 63 off.

Figure 6:
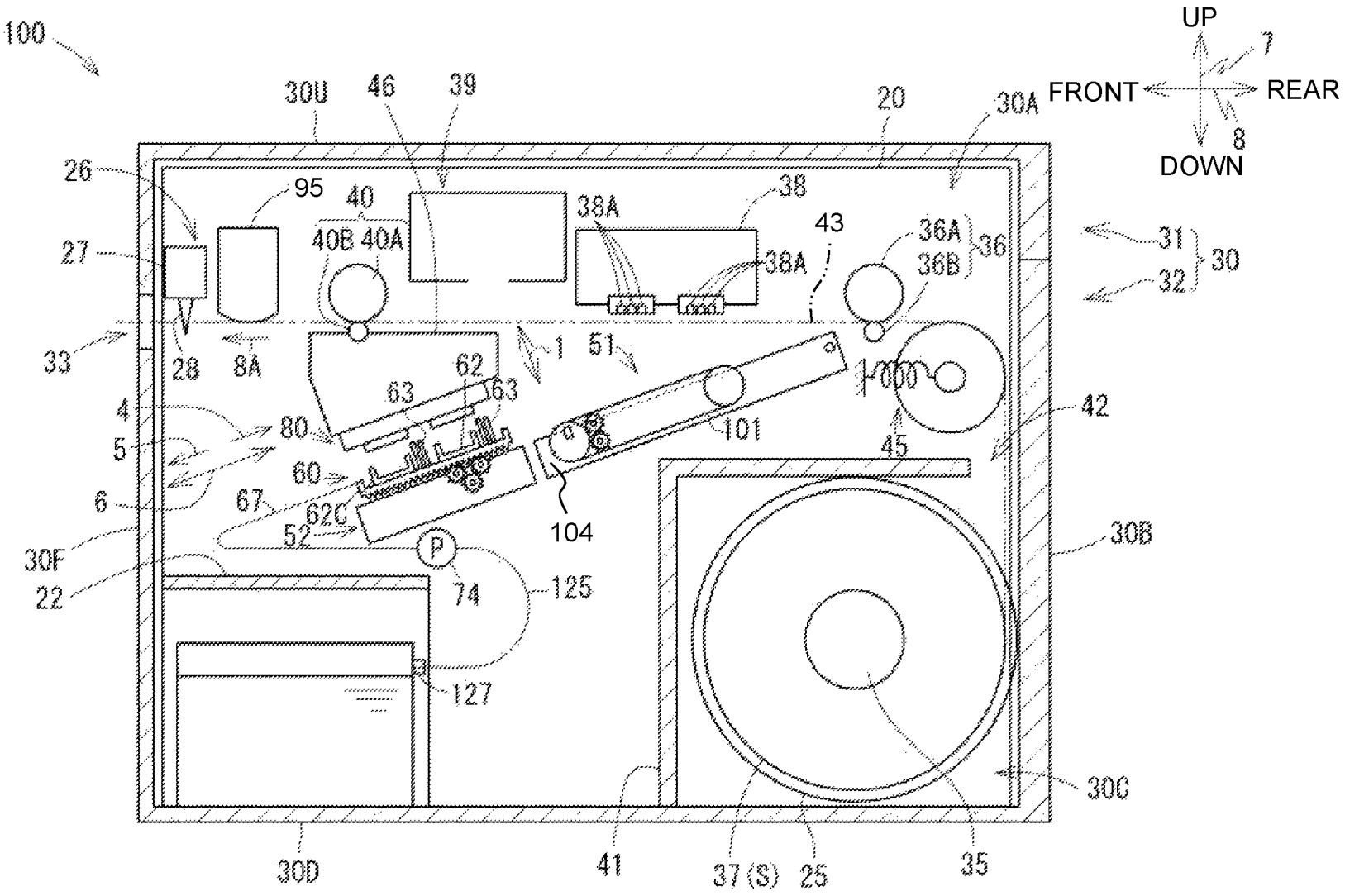
FIG. 6 is a cross-sectional view taken along a line IV-IV of FIG. 1, wherein the maintenance unit is in the standby position and the first support mechanism has pivoted downward.

As depicted in FIG. 4, the maintenance unit 60 in the standby position is supported by the second support mechanisms 52. When a motor (not depicted) is driven, as depicted in FIG. 6, a front portion of the first support mechanism 51 pivots to move downward. This allows the maintenance unit 60 to move from the second support mechanism 52 to the first support mechanism 51. The maintenance unit 60 in the standby position moves in an orientation 4 in the inclination direction 6 while being guided by the second support mechanism 52 and the first support mechanism 51 and then the maintenance unit 60 is supported by the first support mechanism 51.

Figure 7:
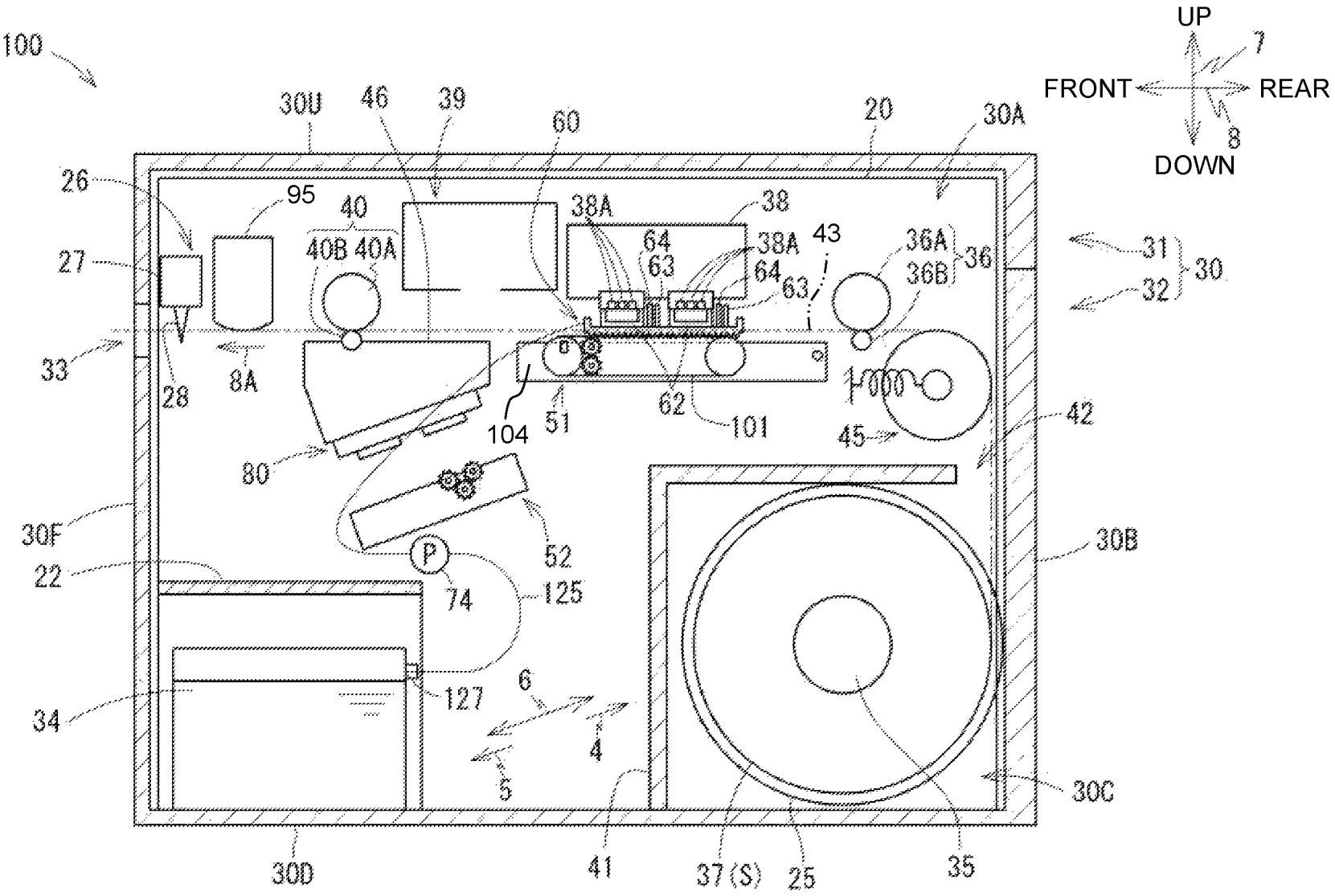
FIG. 7 is a cross-sectional view taken along the line IV-IV of FIG. 1, wherein the maintenance unit is in a maintenance position.

Driving force is transmitted from the motor (not depicted) in a state where the maintenance unit 60 is supported only by the first support mechanism 51. This causes the front portion of the first support mechanism 51 to pivot and move upward. Thus, the maintenance unit 60 is positioned in the maintenance position, as depicted in FIG. 7. The standby position is at the front side of the maintenance position and above the tank 34. That is, the standby position is positioned between the maintenance position and the front surface (the first surface) 30F of the casing 30 in the front-rear direction 8 and positioned between the tank 34 and the upper surface (the fifth surface) 30U of the casing 30 in the up-down direction 7.

As depicted in FIG. 7, the head 38 moves downward with respect to the maintenance unit 60 in the maintenance position, thus covering the nozzles 38A with the cap 62 of the maintenance unit 60. The purge process can be executed in this state. The wiping process is executed by moving the maintenance unit 60 positioned in the maintenance position along the first support mechanism 51 in the front-rear direction 8.

When the maintenance unit 60 moves from the maintenance position to the standby position, an operation reverse to the above is executed.

<Positional Relationship in Internal Space 30A of Casing 30>

As depicted in FIG. 4, the tank 34 is positioned at the front side of the sheet accommodating space 30C and the side guides 25 in the front-rear direction 8. As depicted in FIG. 5, a range R3 occupied by the tank 34 partially overlaps with a range R4 occupied by the sheet accommodating space 30C in the left-right direction 9. In this embodiment, a right portion of the range R3 overlaps with a left portion of the range R4. As depicted in FIG. 5, a range R5 occupied by the tank 34 overlaps with a range R6 occupied by the sheet accommodating space 30C in the up-down direction 7. In this embodiment, the range R5 is included in the range R6. In other words, the sheet accommodating space 30C and at least part of the tank 34 are lined up in the front-rear direction 8.

As depicted in FIG. 4 and FIG. 5, the tank 34 and the sheet accommodating space 30C are positioned below the head 38 in the up-down direction 7. A range R7 occupied by the head 38 partially overlaps with a range R8 occupied by the sheet accommodating space 30C in the front-rear direction 8. In this embodiment, a rear portion of the range R7 overlaps with a front portion of the range R8. In other words, the sheet accommodating space 30C and at least part of the head 38 are lined up in the up-down direction 7. A range R9 occupied by the conveying belt 101 partially overlaps with a range R8 occupied by the sheet accommodating space 30C in the front-rear direction 8. In this embodiment, a rear portion of the range R9 overlaps with a front portion of the range R8.

As depicted in FIG. 5, the waste liquid tank 47 is positioned below the head 38 in the up-down direction 7. That is, the waste liquid tank 47 is positioned between the head 38 and the lower surface (the sixth surface) 30D of the casing 30 in the up-down direction 7. A range R10 occupied by the waste liquid tank 47 at least partially overlaps with a range R11 occupied by the head 38 in the left-right direction 9.

As depicted in FIG. 5, a range R12 occupied by the maintenance unit 60 in the standby position at least partially overlaps with the range R6 occupied by the sheet accommodating space 30C in the up-down direction 7. In other words, the sheet accommodating space 30C and at least part of the maintenance unit 60 in the standby position are lined up in the front-rear direction 8.

As depicted in FIG. 5, a joint 111 (an example of a first joint) via which the channel 110 from the tank 34 is coupled to the subtank 83 of the circulation mechanism 81 is positioned at the left of the side frame 20. A joint 121 (an example of a second joint) via which the channel 120 from the head 38 is coupled to the subtank 83 is positioned at the left of the side frame 20. A joint 112 (an example of a third joint) via which the channel 110 connecting the tank 34 and the subtank 83 is coupled to the tank 34 is positioned at the left of the side frame 20.

As depicted in FIG. 5, a joint 126 (an example of a fourth joint) via which the maintenance unit 60 is coupled to the channel 125 connecting the maintenance unit 60 and the waste liquid tank 47 and a joint 127 (an example of a fifth joint) via which the waste liquid tank 47 is coupled to the channel 125 are positioned between the two side frames 20 and 21 in the left-right direction 9.

Working Effect of Embodiment

In the image recording apparatus 100 according to this embodiment, the tank 34 is positioned at the front side of the sheet accommodating space 30C in the front-rear direction 8. That is, the tank 34 is positioned between the front surface (the first surface) 30F of the casing 30 and the sheet accommodating space 30C in the front-rear direction 8. The range R3 occupied by the tank 34 at least partially overlaps with the range R4 occupied by the sheet accommodating space 30C in the left-right direction 9. The range R5 occupied by the tank 34 at least partially overlaps with the range R6 occupied by the sheet accommodating space 30C in the up-down direction 7.

In the above configuration, since the sheet accommodating space 30C and the tank 34 are efficiently arranged in the internal space 30A of the casing 30, the image recording apparatus 100 can be downsized. The dimensions in the front-rear direction 8 and the left-right direction 9 of the image recording apparatus 100 can be downsized. Further, the dimension in the up-down direction 7 of the image recording apparatus 100 can be downsized.

The tank 34 and the sheet accommodating space 30C are positioned below the head 38 in the up-down direction 7. That is, the tank 34 and the sheet accommodating space 30C are positioned between the head 38 and the lower surface (the sixth surface) 30D of the casing 30 in the up-down direction 7.

In the above configuration, the sheet accommodating space 30C and the tank 34 are efficiently arranged in a space below the head 38 in the internal space 30A of the casing 30. The image recording apparatus 100 can thus be downsized.

The range R7 occupied by the head 38 or the range R9 occupied by the conveyance belt 101 partially overlaps with the range R8 occupied by the sheet accommodating space 30C in the front-rear direction 8. In this configuration, the image recording apparatus 100 can be downsized in the front-rear direction 8.

The head 38 and the sheet accommodating space 30C are positioned between the two side frames 20 and 21 in the left-right direction 9. The front portion of the side frame 20 is coupled to the subframe 22. The tank 34 is positioned below the front portion of the side frame 20.

In the above configuration, the tank 34 can be disposed below the front portion of the side frame 20. Since the subframe 22 is coupled to the side frame 20, the position(s) of the member(s) supported by the side frame 20 is/are stabilized.

The substrate 130, on which the controller for controlling operation of the image recording apparatus 100 is mounted, is positioned above the tank 34 at the outside of the side frame 20 supported by the subframe 22. That is, the substrate 130 is positioned between the tank 34 and the upper surface (the fifth surface) 30U of the casing 30 in the up-down direction 7 and positioned between the side frame 20 and the left surface (the third surface) 30L of the casing 30 in the left-right direction 9.

In the above configuration, a space above the tank 34 at the outside of the side frame 20 can be effectively used as an arrangement space of the substrate 130. Since the substrate 130 is positioned above the tank 34, ink stored in the tank 34 is not likely to adhere to the substrate 130.

In the above embodiment, the joint 111 via which the channel 110 from the tank 34 is coupled to the subtank 83 of the circulation mechanism 81 is positioned at the left of the side frame 20 (at the outside of the side frame 20, that is, between the side frame 20 and the left surface (the third surface) 30L of the casing 30 in the left-right direction 9). The joint 121 via which the channel 120 from the head 38 is coupled to the subtank 83 is positioned at the left of the side frame 20 (at the outside of the side frame 20, that is, between the side frame 20 and the left surface (the third surface) 30L of the casing 30 in the left-right direction 9).

In the above configuration, even when ink leaks at the time of installation of the joints 111 and 121, there is no fear that leaked ink contaminates members positioned between the two side frames 20 and 21.

In the above embodiment, the joint 112 via which the channel 110 connecting the tank 34 and the subtank 83 of the circulation mechanism 81 is coupled to the tank 34 is positioned at the left of the side frame 20 (at the outside of the side frame 20, that is, between the side frame 20 and the left surface (the third surface) 30L of the casing 30 in the left-right direction 9). It is thus possible to make the channels 110 and 120 ranging from the tank 34 to the head 38 via the circulation mechanism 81 short.

The joint 126 via which the maintenance unit 60 is coupled to the channel 125 connecting the maintenance unit 60 and the waste liquid tank 47 and the joint 127 via which the waste liquid tank 47 is coupled to the channel 125 are positioned between the two side frames 20 and 21 in the left-right direction 9. It is thus possible to make the channel 125 ranging from the maintenance unit 60 to the waste liquid tank 47 short.

The maintenance unit 60 is movable between the maintenance position where the maintenance unit 60 is brought into contact with the head 38 and the standby position where the maintenance unit 60 is separated from the head 38. The standby position is at the front side of the maintenance position and above the tank 34. That is, the standby position is positioned between the maintenance position and the front surface (the first surface) 30F of the casing 30 in the front-rear direction 8 and positioned between the tank 34 and the upper surface (the fifth surface) 30U of the casing 30 in the up-down direction 7.

In the above configuration, the sheet accommodating space 30C, the tank 34, and the maintenance unit 60 are efficiently arranged in the internal space 30A of the casing 30. The image recording apparatus 100 can thus be downsized.

The discharge roller pair 40 conveying the sheet is positioned at the front side of the head 38 in the front-rear direction 8. That is, the discharge roller pair 40 is positioned between the head 38 and the front surface (the first surface) 30F of the casing 30 in the front-rear direction 8. The maintenance unit 60 moves frontward and downward along the inclination direction from the maintenance position to the standby position. That is, the maintenance unit 60 moves to approach the front surface (the first surface) 30F and the lower surface (the sixth surface) 30D of the casing 30 from the maintenance position toward the standby position.

In the above configuration, the maintenance unit 60 does not interfere with the discharge roller pair 40.

According to the above embodiment, part of the range R1 occupied by the window 18 does not overlap with the range R2 occupied by the discharge opening 33 in the left-right direction 9. Thus, even when the sheet S discharged from the discharge opening 33 hangs down, the entire front portion of the window 18 is not covered with the sheet S. Thus, a user visually recognizes the tank 34 through the window 18 easily.

Modifications

In the above embodiment, the conveyance belt 101 is adopted as the supporter (the support material) that supports the sheet S. Instead of that, a publicly known member supporting the sheet S such as a platen may be adopted.

In the above embodiment, the range R3 partially overlaps with the range R4, the range R7 partially overlaps with the range R8, and the range R8 partially overlaps with the range R9. However, the range R3, the range R7, and the range R8 may respectively overlap with the range R4, the range R8, and the range R9 completely. Or, one of the ranges R3 and R4 may be included in the other, one of the ranges R7 and R8 may be included in the other, and one of the ranges R8 and R9 may be included in the other. Similarly, in the above embodiment, the range R5 partially overlaps with the range R6, the range R10 partially overlaps with the range R11, and the range R6 partially overlaps with the range R12. However, the range R5, the range R10, and the range R6 may respectively overlap with the range R6, the range R11, and the range R12 completely. Or, one of the ranges R5 and R6 may be included in the other, one of the ranges R10 and R11 may be included in the other, and one of the ranges R6 and R12 may be included in the other.

What is claimed is:

1. A liquid discharge apparatus, comprising:

a casing having: a first surface and a second surface positioned apart from each other in a first direction; a third surface and a fourth surface positioned apart from each other in a second direction perpendicular to the first direction; and a fifth surface and a sixth surface positioned apart from each other in a third direction perpendicular to the first direction and the second direction;

a head positioned in an internal space of the casing and configured to discharge a liquid droplet;

a tank positioned in the internal space of the casing and configured to store a liquid to be supplied to the head; and a sheet accommodating portion positioned in the internal space of the casing and configured to accommodate a sheet, wherein the tank is positioned between the first surface of the casing and the sheet accommodating portion in the first direction, a range in the second direction occupied by the tank at least partially overlaps with a range in the second direction occupied by the sheet accommodating portion, and a range in the third direction occupied by the tank at least partially overlaps with a range in the third direction occupied by the sheet accommodating portion.

2. The liquid discharge apparatus according to claim 1, wherein the tank and the sheet accommodating portion are positioned between the head and the sixth surface of the casing in the third direction.

3. The liquid discharge apparatus according to claim 1, further comprising a supporter facing the head in the internal space of the casing and configured to support the sheet, wherein a range in the first direction occupied by the head or a range in the first direction occupied by the supporter at least partially overlaps with a range in the first direction occupied by the sheet accommodating portion.

4. The liquid discharge apparatus according to claim 3, wherein the supporter is a conveyance belt unit in which a belt is wound around at least two rollers.

5. The liquid discharge apparatus according to claim 1, further comprising a first side frame and a second side frame positioned apart from each other in the second direction in the internal space of the casing, wherein the head and the sheet accommodating portion are positioned between the first side frame and the second side frame in the second direction.

6. The liquid discharge apparatus according to claim 5, further comprising a subframe in the internal space of the casing, the subframe having a first wall facing the tank in the second direction and a second wall facing the tank in the third direction, wherein the third surface of the casing, the first side frame, the second side frame, and the fourth surface of the casing are arranged in this order in the second direction, a part of the first side frame at a side of the first surface in the first direction is coupled to the subframe to form a coupling portion, and the tank is positioned between the coupling portion and the sixth surface of the casing in the third direction.

7. The liquid discharge apparatus according to claim 6, wherein a cutout is formed at a corner, of the first side frame, at the side of the first surface in the first direction and at a side of the sixth surface in the third direction, the second wall of the subframe extends in the second direction to form the coupling portion by being coupled to a part, of the first side frame, in which the cutout is formed, and is further coupled to the second side frame, the first wall of the subframe is positioned between the first side frame and the third surface of the casing in the second direction, and extends in the third direction to couple the second wall of the subframe to a wall including the sixth surface of the casing, and the tank is positioned between the first wall of the subframe and the second side frame in the second direction and positioned between the second wall of the subframe and the sixth surface of the casing in the third direction.

8. The liquid discharge apparatus according to claim 6, further comprising a substrate, on which a controller is mounted, positioned in the internal space of the casing, the controller being configured to control operation of the liquid discharge apparatus, wherein the substrate is positioned between the tank and the fifth surface of the casing in the third direction and positioned between the first side frame and the third surface of the casing in the second direction.

9. The liquid discharge apparatus according to claim 6, further comprising a supply unit positioned between the first side frame and the third surface of the casing in the second direction in the internal space of the casing and configured to supply the liquid from the tank to the head, wherein the supply unit includes a subtank, and a first joint via which a channel from the tank is coupled to the subtank and a second joint via which a channel from the head is coupled to the subtank are positioned between the first side frame and the third surface of the casing in the second direction.

10. The liquid discharge apparatus according to claim 9, wherein a third joint via which a channel connecting the tank and the subtank is coupled to the tank is positioned between the first side frame and the third surface of the casing in the second direction.

11. The liquid discharge apparatus according to claim 5, further comprising a maintenance unit positioned between the first side frame and the second side frame in the second direction and configured to receive the liquid discharged from the head in a state of being brought into contact with the head, wherein the maintenance unit is movable between a maintenance position where the maintenance unit is brought into contact with the head and a standby position where the maintenance unit is separated from the head, and the standby position is positioned between the maintenance position and the first surface of the casing in the first direction and positioned between the tank and the fifth surface of the casing in the third direction.

12. The liquid discharge apparatus according to claim 11, further comprising a conveyance unit positioned between the head and the first surface of the casing in the first direction and configured to convey the sheet, wherein the maintenance unit is configured to move toward the standby position from the maintenance position so that the maintenance unit approaches the first surface and the sixth surface of the casing.

13. The liquid discharge apparatus according to claim 11, further comprising a waste liquid tank configured to hold the liquid discharged from the maintenance unit, wherein the waste liquid tank is positioned between the head and the sixth surface of the casing in the third direction, and a range in the second direction occupied by the waste liquid tank at least partially overlaps with a range in the second direction occupied by the head.

14. The liquid discharge apparatus according to claim 13, wherein the tank and the waste liquid tank are installable and removable with respect to the casing, the first surface of the casing is formed having an opening through which a user is accessible to the tank and the waste liquid tank and the first surface of the casing is provided with a cover configured to open and close the opening.

15. The liquid discharge apparatus according to claim 13, wherein a fourth joint via which a channel connecting the maintenance unit and the waste liquid tank is coupled to the maintenance unit is positioned between the first side frame and the second side frame in the second direction, and a fifth joint via which the channel connecting the maintenance unit and the waste liquid tank is coupled to the waste liquid tank is positioned between the first side frame and the second side frame in the second direction.

16. The liquid discharge apparatus according to claim 1, further comprising a maintenance unit configured to receive the liquid discharged from the head in a state of being brought into contact with the head, wherein the maintenance unit is movable between a maintenance position where the maintenance unit is brought into contact with the head and a standby position where the maintenance unit is separated from the head, and the standby position is positioned between the maintenance position and the first surface of the casing in the first direction and positioned between the tank and the fifth surface of the casing in the third direction.

17. The liquid discharge apparatus according to claim 16, wherein a range in the third direction occupied by the maintenance unit in the standby position at least partially overlaps with the range in the third direction occupied by the sheet accommodating portion.

18. The liquid discharge apparatus according to claim 1, further comprising a fixing unit positioned between the first surface of the casing and the head in the first direction and configured to fix the liquid adhering to the sheet to the sheet.

19. The liquid discharge apparatus according to claim 1, wherein the first surface of the casing is formed having a discharge opening through which the sheet is discharged and a translucent window that allows a user to visually recognize the tank from an outside of the liquid discharge apparatus, and at least a part of a range in the second direction occupied by the window does not overlap with a range in the second direction occupied by the discharge opening.

20. The liquid discharge apparatus according to claim 1, wherein the sheet forms a sheet roll, and the sheet accommodating portion further includes a side guide brought into contact with an end in the second direction of the sheet roll.

* * * * *